US006305449B1

(12) United States Patent
Stover

(10) Patent No.: US 6,305,449 B1
(45) Date of Patent: Oct. 23, 2001

(54) ADJUSTABLE ROUTER TABLE JIG

(76) Inventor: David Andrew Stover, 313 Orange St., Arlington, TX (US) 76012-3925

( * ) Notice: Subject to any disclaimer, the term of this patent is extended or adjusted under 35 U.S.C. 154(b) by 0 days.

(21) Appl. No.: 09/573,449

(22) Filed: May 16, 2000

(51) Int. Cl.[7] ..... B27M 1/00

(52) U.S. Cl. ..... 144/371; 144/135.2; 144/253.2; 144/253.5; 144/253.6; 144/251.2; 144/252.1

(58) Field of Search ..... 144/134.1, 135.2, 144/253.2, 253.5, 204.2, 371, 372, 251.2, 252.1, 253.6

(56) References Cited

U.S. PATENT DOCUMENTS

| | | | | |
|---|---|---|---|---|
| 368,761 | | 8/1887 | Ferguson . | |
| 2,916,063 | | 12/1959 | Boekenkamp . | |
| 2,972,366 | * | 2/1961 | Caruso | 144/204.2 |
| 3,604,484 | | 9/1971 | Viljoen . | |
| 4,462,440 | | 7/1984 | Dolfi . | |
| 4,655,445 | | 4/1987 | Morse . | |
| 4,809,755 | | 3/1989 | Pontikas . | |
| 5,139,062 | | 8/1992 | Keller . | |
| 5,289,861 | | 3/1994 | Hedrick . | |
| 5,337,641 | | 8/1994 | Duginske . | |
| 5,421,384 | | 6/1995 | Nuwordu . | |
| 5,823,239 | | 10/1998 | Smith . | |
| 5,832,977 | | 11/1998 | Hampton . | |
| 5,890,524 | | 4/1999 | Tucker . | |
| 5,931,208 | | 8/1999 | Gifkins . | |
| 6,041,837 | * | 3/2000 | Hanson | 144/253.2 |

FOREIGN PATENT DOCUMENTS 1217999 1/1971 (ZA) .

OTHER PUBLICATIONS

Spielman, Patrick; Router Jigs & Techniques; Sterling Publishing Co., Inc., New York.

Kemmet, Marlen; Universal Tablesaw with Laser Accuracy, Better Homes and Gardens Wood Magazine; Dec. 1996, pp. 70–75, 100, 102; vol. 13, No. 9, Issue No. 93; Meredith Corporation, Des Moines, Iowa.

Kemmet, Marlen; Box–Joint Jig, Better Homes and Gardens Wood Magazine; Oct. 1998, pp. 44–49; vol. 15, No.6, Issue No. 108; Meredith Corporation, Des Moines, Iowa.

* cited by examiner

*Primary Examiner*—W. Donald Bray
(74) *Attorney, Agent, or Firm*—David W. Carstens; Carstens, Yee & Cahoon, L.L.P

(57) ABSTRACT

The present invention facilitates the fabrication of an unlimited variety of dovetail joints without the use of standardized template devices. Additionally, the device is capable of supporting a workpiece on both sides of the router bit cutting edge and adjusting the angular orientation of the guiding fence in relation to the axis of directional translation. The device is comprised of a router table and a slideably coupled positioning apparatus. The router table comprises a tabletop and means for securing a router so that the router's cutting bit extends upwardly through a central orifice. The upper surface of the router table has two longitudinal guide grooves which are parallel to one another and equally spaced on opposite sides of the central orifice. The positioning apparatus is comprised of a guide fence unit with two pivotally secured parallel runners. The runners are adapted to slideably fit into the longitudinal guide grooves in the upper surface of router table and allow the guide fence unit to track along the longitudinal axis of the tabletop. The runners are adapted to selectively position the guide fence unit at one of a plurality of predetermined angles with respect to the base line on a graduated angular scale. A sighting aperture in the forward leading edge of the guide fence unit provides the user with a line-of-sight to properly align the workpiece in relation to the router's cutting bit.

8 Claims, 5 Drawing Sheets

ADJUSTABLE ROUTER TABLE JIG

TECHNICAL FIELD

This invention generally relates to a method and device for selectively positioning and accurately aligning workpieces for precise cutting on a router table. More particularly, though not exclusively, the invention relates to an apparatus and method for fashioning dovetail joints on a router table.

DESCRIPTION OF THE RELATED ART

A dovetail joint is a means by which to adjoin and interlock the abutting edges of two workpieces. The use of dovetail joints between perpendicular wooden member is well known and long practiced in the art of woodworking. The dovetail joint has a long history in woodworking and is still viewed as the signature joint of fine craftsmanship. It is commonly used by cabinetmakers to join together corners of better-quality drawers and casework.

Forming a dovetail joint requires cutting a dovetail board and a pin board. As shown in FIGS. 1A and 1B, the dovetail board 10 includes individual tails 12 separated by pin sockets 14 for receiving the pin board 20. A dovetail is distinguished in that it is wider at its free end than at its interior end. All surfaces of dovetail sockets 14 extend perpendicular to the major surfaces of dovetail board 10. The pin board 20 includes wedge-shaped pins 22 extending from an end of pin board 20 spaced so as to define sockets for receiving dovetails. Side surfaces 24 of pins 22 extend perpendicular to a base 26. Pin exterior sides 28*b* are narrower than pin interior sides 28*a*. Pins 22 are sized, shaped, and positioned to mate with pin sockets 14 in the tail board when pins 22 are inserted into sockets 14. The distinctive shape of the dovetail joint provides a larger gluing surface than other forms of joinery. (e.g., butt joint, lap joint, box joint, etc.) The joint is also valued because it provides a form of mechanical lock should the glue fail. The wedge shape of pins 22 combined with the wider free ends of dovetails 12 prevents pins 22 from being extracted from dovetail board 10 except in a direction parallel to a major surface of pin board 20. However, with today's much stronger and more durable glues, the dovetail joint has become more decorative than functional.

Dovetail joints were once fashioned exclusively by hand utilizing specialized handsaws and sharp chisels. Over the years a variety of jigs, templates, tooling arrangements and fixtures have been created for the purpose of trying to fashion dovetail joints in abutting workpieces. Once a hallmark of the skilled craftsman only, dovetail joints are now easily produced utilizing a variety of methods employing many commonly available power tools. One such tool is the electric router.

The electric router is fast becoming a mainstay of both the commercial and personal woodshop. The versatility of the Touter to fashion decorative edges and join pieces of wood is well renowned. There are three generally recognized methods for utilizing electric routers: (1) hand-held mode, (2) overarm mode , and (3) router table mode. An especially attractive quality of the router is that the same router may be used in all three modes. Numerous jigs and fixtures currently exist to adapt an off-the-shelf router into any one of the three modes. The router table has quickly become an inexpensive and flexible alternative to heavy-duty shapers. The use of an electric router to fashion dovetail joinery is one of the more recent innovative applications. A method rapidly gaining acceptance by the general public involves an electric router utilizing specialized router bits and unique dovetailing templates. In general, two variants of the router/template method currently exist for producing dovetail joints. Both variants include affixing a unique template appliance onto the workpiece to precisely guide a router through the workpiece.

In one variant, the router is fixed in a router table arrangement and the user guides the workpiece by hand. Generally, a router is mounted below a support platform with the cutting bit of the router extending upwardly through a central orifice in the support platform. A guide bushing or template follower means is fixed to the support platform surrounding the cutter bit. A selected template is fixed to a fence which is in-turn clamped to the workpiece. With the workpiece in a proper position over the edge patterns on the template apparatus, the user moves the apparatus into contact with the guide bushing surrounding the router cutter bit. The appropriate joint configuration is thereby cut into the workpiece. U.S. Pat. No. 4,809,755 to Pontikas and U.S. Pat. No. 5,931,208 to Gifkins are representative of prior art efforts which incorporate such a method and device.

In the other variant, the workpiece is fixed and the user guides a hand-held router through the workpiece. Generally, a workpiece is either clamped in to a template mechanism or the template device is directly attached or clamped onto the workpiece which is in-turn attached to a stable fixture. A hand-held router, equipped with a guide bushing or template follower device, is thereupon physically maneuvered by the user along the guiding edge of the template. The appropriate joint configuration is thereby cut into the workpiece. U.S. Pat. No. 5,139,062 to Keller, U.S. Pat. No. 5,421,384 to Nuwordu and U.S. Pat. No. 5,832,977 to Hampton are representative of prior art efforts which incorporate such a method and device.

While the previously referenced devices are all capable of producing adequately precise dovetail joints, they all exhibit drawbacks inherent to their design. The very strength of any template-based design is its inherent weakness. Templates enable the user to quickly and easily reproduce accurate cuts under very controlled conditions. However, as the conditions change, a new template must be fashioned to accommodate the variation. Router bits specifically designed for use in cutting dovetails come in a wide variety of sizes and angles. As shown in FIG. 2., a dovetail router bit 30 is distinguished from a straight router bit 40 by the angulation of its cutting edge. Whereas the straight router bit 40 is variable only in terms of its height 42 and width 44, the dovetail router bit 30 is variable in terms of its height 32, width 34, and angle of inclination 36. All three variables of the dovetail router bit affect the template's design. Additionally, the width/length and thickness of the workpiece also affects the design of the template. Furthermore, the template's design is also affected by the spacing of the dovetail joint's pins and tails. Consequently, a unique template design is required for each combination of conceivable variables. While in theory an infinite number of unique templates may be fashioned, in practice the average woodworker is limited to a few standardized templates. What is needed is a more flexible device capable of aligning a workpiece to cut an infinite variety of dovetail joints without the use of standardized template devices.

Router table fence mechanisms are a natural starting point of suitable alternatives, however, current router table fence devices are not well adapted to cutting dovetail joinery. Several table saw miter gauge devices are adaptable for use as router table fence mechanisms, but there are inherent differences between the cutting mechanics of router tables and table saws which make such adaptations ill suited. While conventional table saw miter gauge devices, as exemplified in U.S. Pat. No. 5,038,486 to Ducate, are superb at varying the angular orientation of the workpiece to the direction of translation, they cannot support the workpiece on both sides of the cutting edge when fashioning a dovetail joint on a router table. This results in undesirable vibration or chatter in the workpiece.

Sled mechanisms incorporating a supporting fence on both sides of the cutting edge are known and practiced in the art. However, as shown in U.S. Pat. No. 5,779,407 to Tucker et al., or as disclosed in the text of "Box-Joint Jig," published in Wood magazine, Issue 108, October 1998, such devices are typically fixed in position allowing only cuts perpendicular to workpiece's direction of translation. While such devices are capable of producing "finger" or "box" joints, they are poorly suited for producing the angled cuts required for dovetail joints.

SUMMARY OF THE INVENTION

This invention overcomes the problems and disadvantages of the prior art by facilitating the fabrication of an unlimited variety of dovetail joints without the use of standardized template devices. The device of the present invention also allows dovetail joints to be fashioned in workpieces of varying dimensions utilizing a wide variety of variably sized router bits. Additionally, the device is capable of supporting a workpiece on both sides of the router bit cutting edge and adjusting the angular orientation of the guiding fence in relation to the axis of directional translation.

Accordingly, it is an object of the present invention, as embodied and broadly described herein, to provide an adjustable router table jig which enables a table-mounted router to be used more effectively and safely.

It is an additional object of the present invention to provide an adjustable router table jig which enables a more accurate alignment of workpieces for precise cutting by a table-mounted router.

It is yet another object of the present invention to provide an adjustable router table jig that facilitates the fabrication of dovetail joints.

The device is comprised of a router table and a slideably coupled positioning apparatus. The router table comprises a tabletop incorporating a horizontally positioned router support platform having a central orifice and means for securing the housing of the router to the support platform so that the cutting bit of the router extends upwardly through the central orifice. The longitudinal axis of the cutting bit is perpendicular to the upper surface of the router support platform. The upper surface of the router table has two longitudinal guide grooves which are parallel to one another and equally spaced on opposite sides of the central orifice. A graduated angular scale with its base line oriented perpendicular to the longitudinal orientation of the router table guide grooves is also provided. The positioning apparatus is comprised of a guide fence unit with two pivotally secured parallel runners. The runners are adapted to slideably fit into the longitudinal guide grooves in the upper surface of router table and allow the guide fence unit to track along the longitudinal axis of the tabletop. The guide fence unit comprises a rectangular base plate attached to a vertical guide plate. The vertical guide plate is affixed to the forward abutting edge of the base plate and is perpendicular to the base plate and the upper surface of the router support platform. The two parallel runners, pivotally secured to the base plate, are adapted to selectively position the guide fence unit at one of a plurality of predetermined angles with respect to the base line on the graduated angular scale. A sighting aperture in the forward leading edge of the guide fence unit provides the user with a line-of-sight to properly align the workpiece in relation to the router cutting bit. A translucent cover plate mounted on two blocks protruding from the base plate unit and adjacent to the inner face of the guide fence unit protects against flying debris ejected by the router bit through the sighting aperture. An optional horizontal periscopic optical unit mounted at the rear of the base plate allows the user to align the workpiece from an position overhead the device.

A better understanding of the features and advantages of the present invention will be obtained by reference to the following detailed description of the invention and accompanying drawings which set forth an illustrative embodiment in which the principles of the invention are utilized.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION

Figure 3:
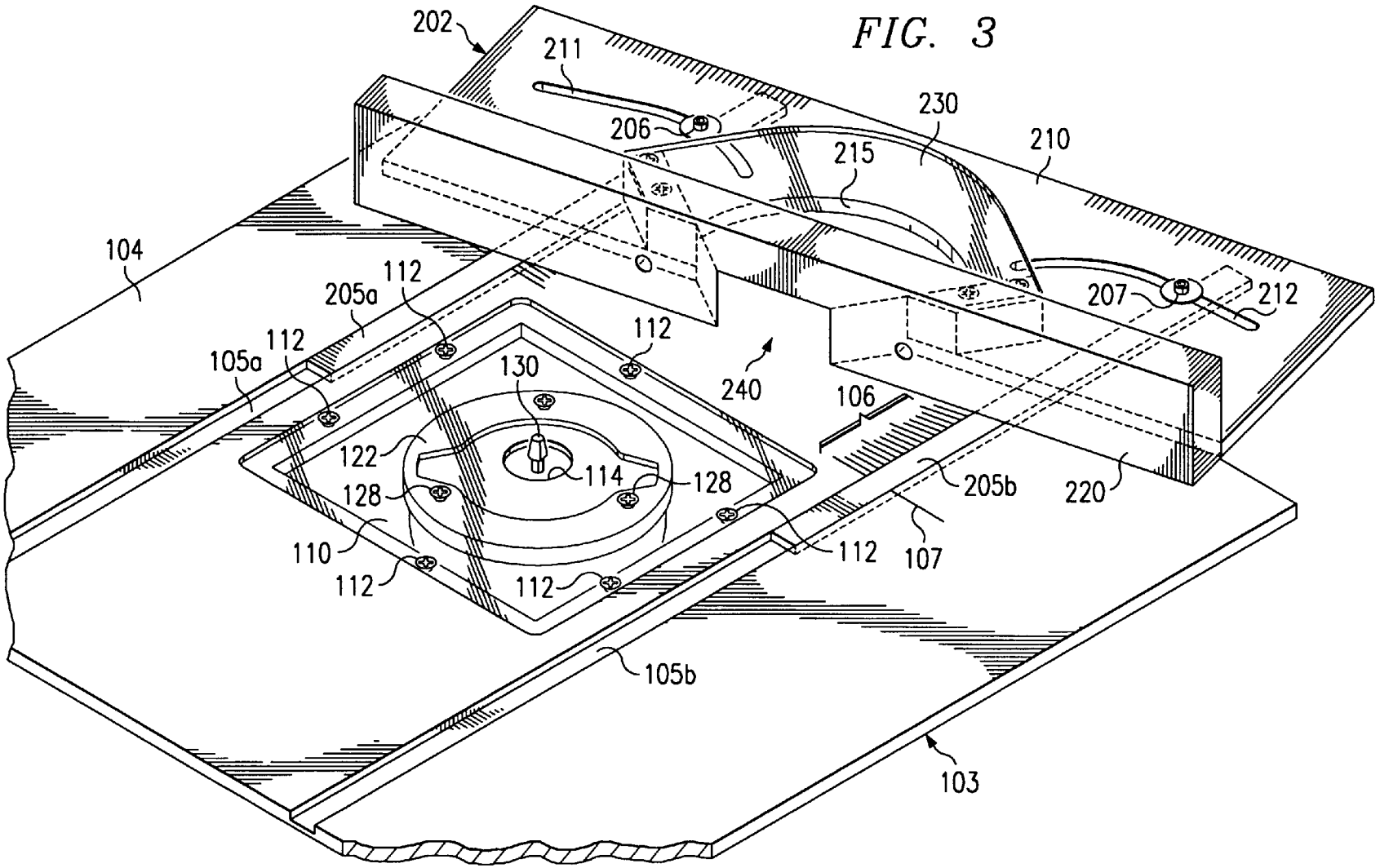
FIG. 3 is a frontal perspective view of the adjustable router table jig device of the present invention.
Figure 4:
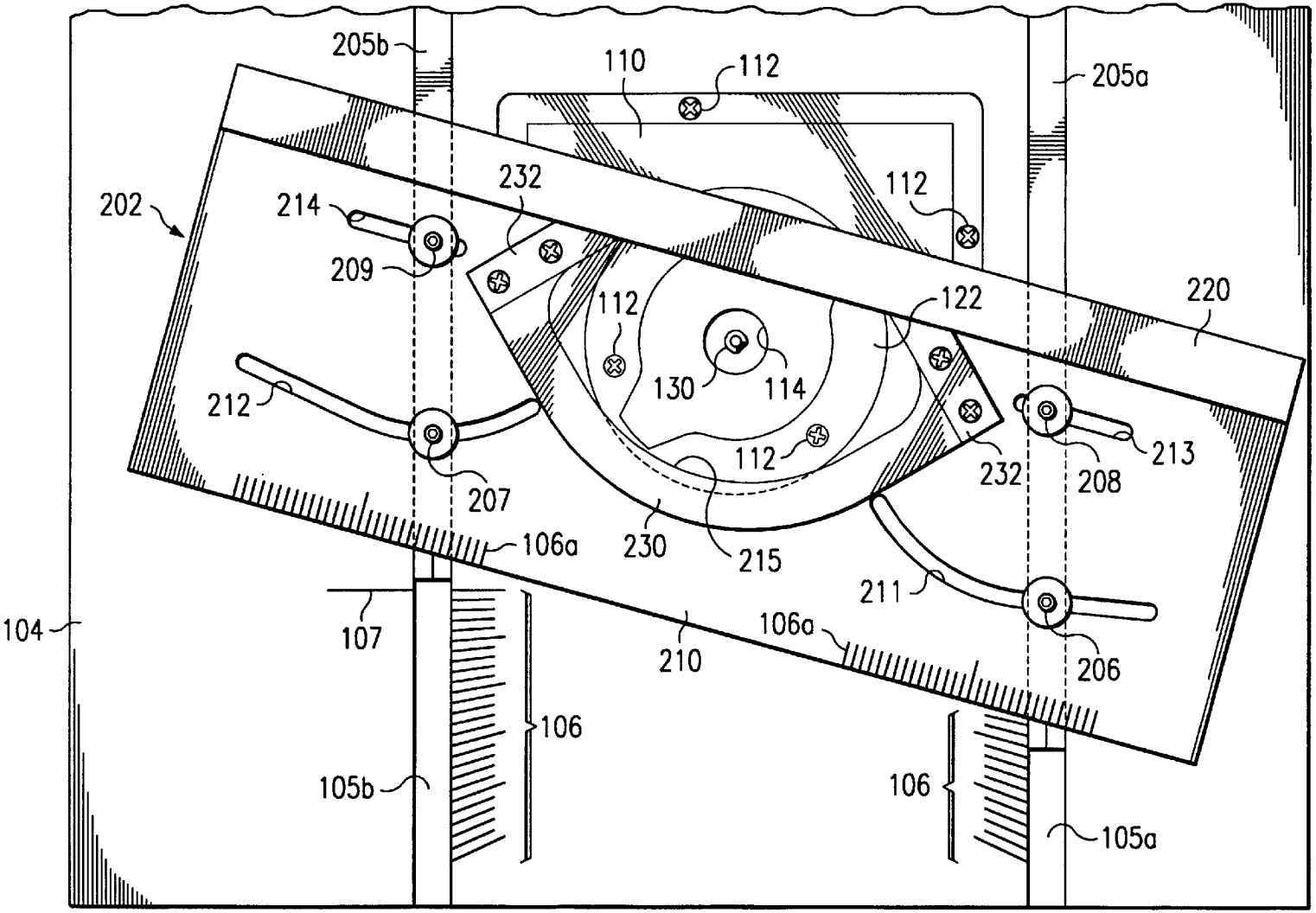
FIG. 4 is a overhead perspective view of the adjustable router table jig device of the present invention.

FIGS. 3 and 4 show an adjustable router table device constructed in accordance with the present invention. The device is comprised of a router table tabletop 103 and a slideably coupled positioning apparatus 200. The router table may be constructed according to one of a number of known router table construction methods. A typical router table includes a base unit and tabletop 103. The tabletop 103 is typically coupled to an upper portion of the base unit.

A router support platform 110 is inserted into a correspondingly sized opening in the center of tabletop 103. It is understood that the router support platform 110 may be comprised of a thin metal or plastic insert which is supported by the ledge of the opening cutout. Multiple attachment screws 112 serve to securely anchor the router support platform 110 flush with tabletop 103.

A router is secured to the underside of the router support platform 110 by attaching the router housing base 122 to the router support platform 110. In one embodiment, attachment screws 128 screwed into tapped holes in the router housing base 122 are utilized. A collar device (not shown) according to any of a number of router attachment methods, including U.S. Pat. Nos. 5,715,880 or 5,289,861 may also be utilized. Once router housing base 122 is attached to router support platform 110, the router motor element 124 and affixed cutting bit 130 may then be slideably adjusted within the housing base 122 and secured utilizing the applicable router's locking means.

A central orifice 114 in the router support platform 110 allows a cutting bit 130 to extend upwardly through the router support platform 110 and correspondingly the plane of upper surface 104 of tabletop 103. The longitudinal axis of a cutting bit 130 properly affixed in an attached router 120 is perpendicular to the horizontal plane of router support platform 110 and correspondingly the horizontal plane of upper surface 104 of tabletop 103.

Two parallel alignment guide grooves 105*a* and 105*b*, milled or formed into the upper surface 104 of tabletop 103, are oriented such that they are equidistant from and on opposite sides of the central orifice 114 of the router support platform 110. The two guide grooves 105*a* and 105*b* define the longitudinal orientation of tabletop 103. A graduated angular scale 106, with its base line 107 oriented perpendicular to the longitudinal axis defined by guide grooves 105*a* and 105*b*, is inscribed onto the upper surface 104 of tabletop 103.

Figure 1A:
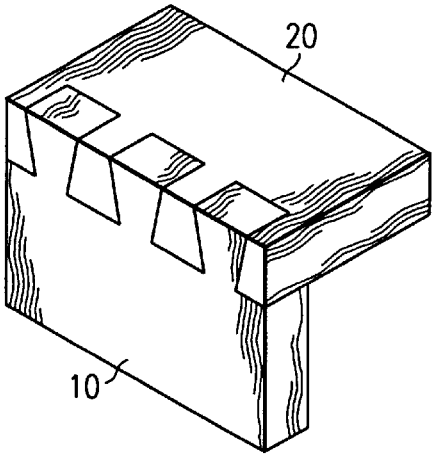
FIG. 1A (PRIOR ART)
FIG. 1A is a perspective view of a prior art dovetail joint.
Figure 1B:
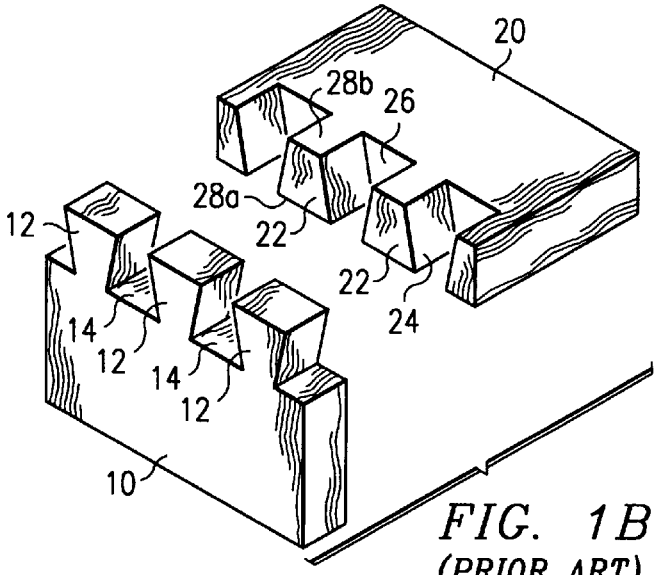
FIG. 1B (PRIOR ART)
FIG. 1B is a perspective view of two boards cut to form a prior art dovetail joint.
Figure 2:
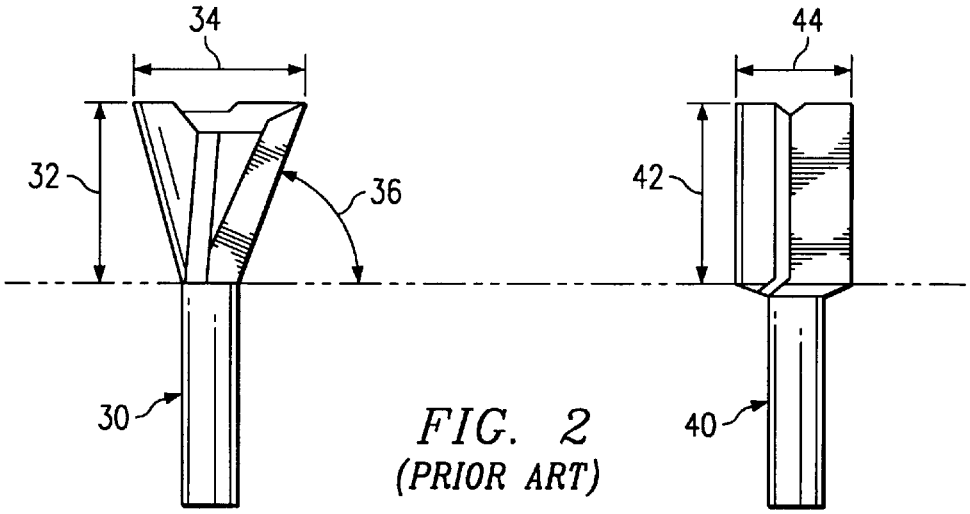
FIG. 2 (PRIOR ART)
FIG. 2 is a side elevational view of selected prior art router bits.
Figure 5A:
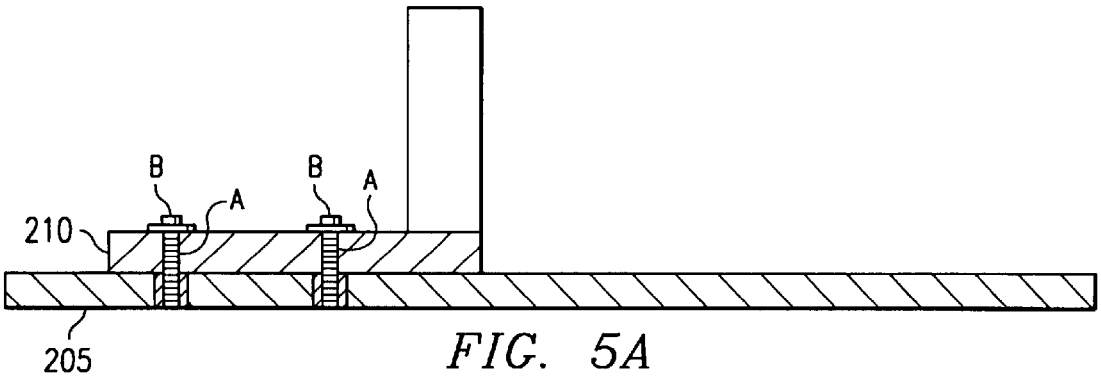
FIG. 5A is a cross-sectional view of one embodiment of coupling and locking means of adjustable router table jig device of the present invention.
Figure 5:
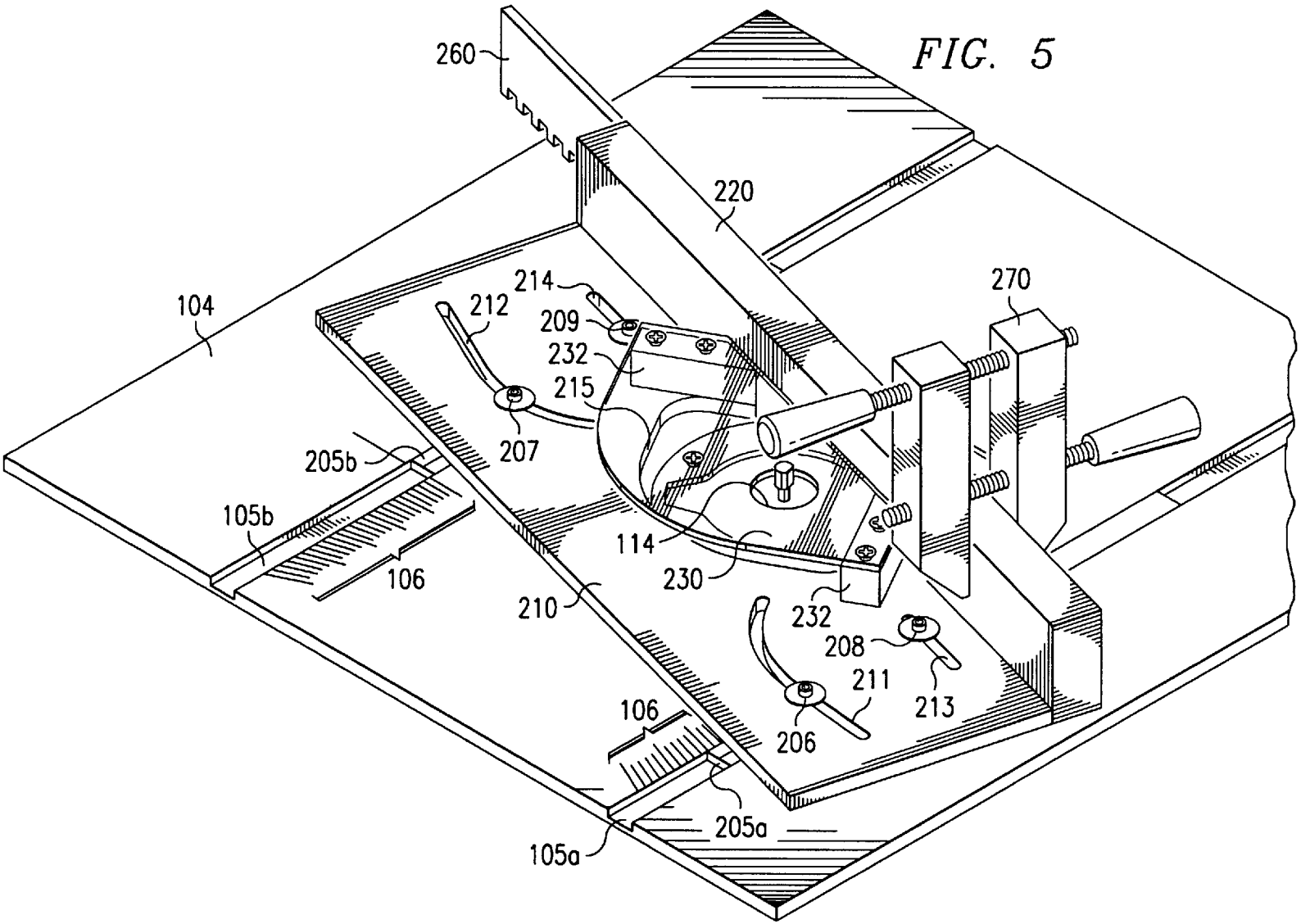
FIG. 5 is a rear perspective view of the adjustable router table jig device of the present invention.
Figure 6:
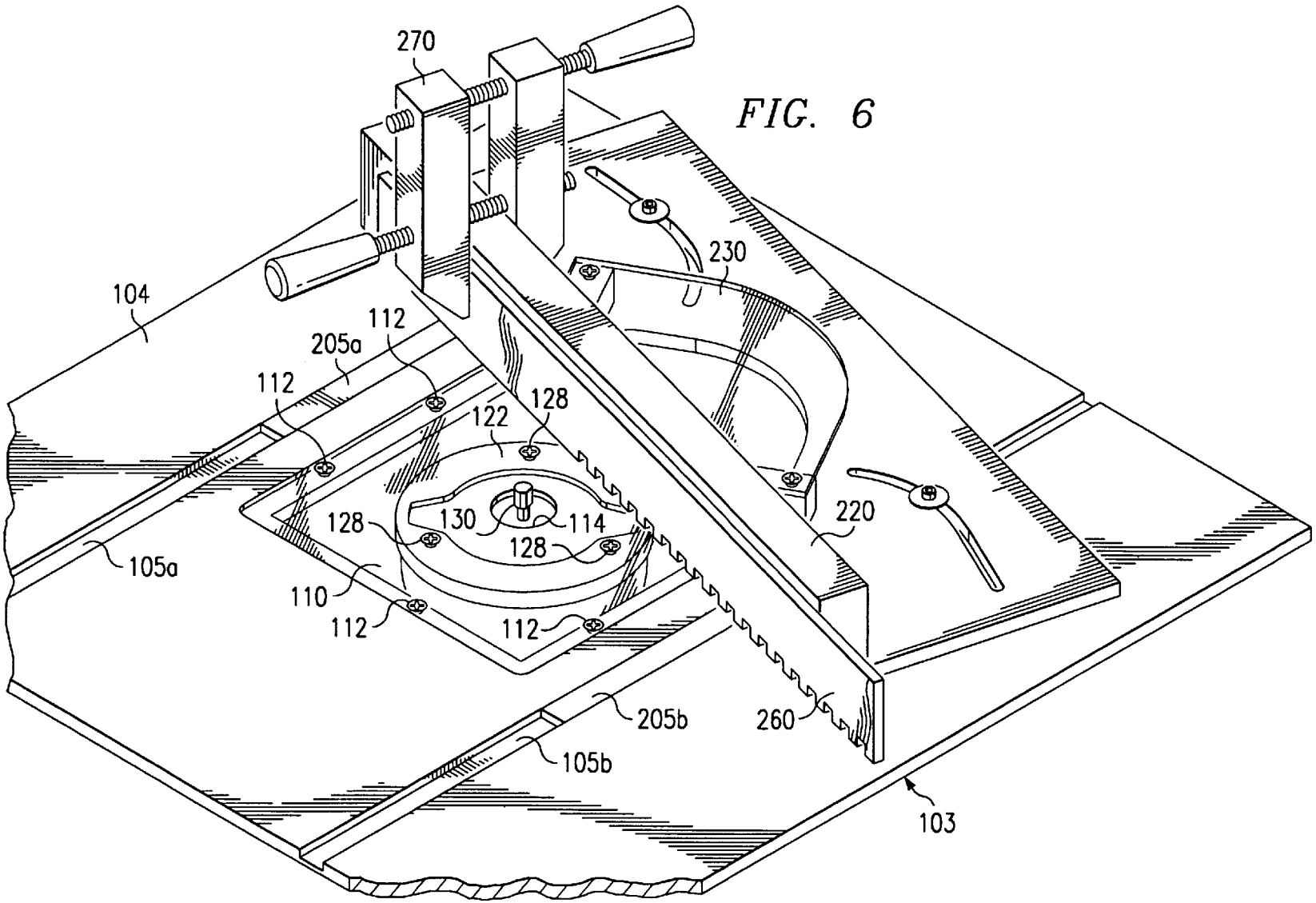
FIG. 6 is a frontal perspective view of the adjustable router table jig device of the present invention with auxiliary strip in place.

Referring to FIGS. 3, 4, and 5, the positioning apparatus 200 is comprised of a guide fence unit 202 with two pivotally secured parallel runner guide bars 205*a* and 205*b*. The runner guide bars 205*a* and 205*b* are adapted to slideably fit into guide grooves 105*a* and 105*b* in tabletop 103 and allow the attached guide fence unit 202 to track along the longitudinal axis of tabletop 103.

The guide fence unit 202 is comprised of a rectangular base plate 210 attached to a vertical guide plate 220. Vertical guide plate 220 is affixed to the forward abutting edge of the base plate 210 and is aligned perpendicular to the horizontal plane of base plate 210 such that when properly positioned on tabletop 103, the vertical guide plate 220 is also perpendicular to the horizontal plane of upper surface 104 of tabletop 103.

A sighting aperture 240 located at the center, lower quadrant of the guide fence unit 202 allows the user to visually align the workpiece as will be later explained.

Base plate 210 is comprised of a rectangular piece with a central cavity 215 along its forward abutting edge and means for coupling and locking base plate 210 with runner guide bars 205*a* and 205*b*. Central cavity 215 connects with sighting aperture 240 and further enables user to visually align the workpiece as will be explained later. Central cavity 215 also serves as an exit duct allowing debris to be ejected away from the immediate cutter area. A protective cover shield 230 is strategically placed on two support block 232 to protect the user from debris ejected through the sighting aperture 240 and cavity 215. It is understood that cover shield 230 is constructed of a translucent, impact-resistant material.

Coupling and locking means allow the guide fence unit 202 to be pivotally positioned in relation to the runner guide bars 205*a* and 205*b*. When unlocked, coupling means allows the base plate 210 and corresponding guide fence unit 202 to pivot freely and be aligned to an angular scale. When locking means is engaged, the orientation of the guide fence unit 202 to the runner guide bars 205*a* and 205*b* is firmly set in place.

In one embodiment, base plate's 210 coupling and locking means is comprised of slots 211, 212, 213, and 214 which advantageously allow friction fittings 206, 207, 208, and 209 to couple the base plate 210 to runner guide bars 205*a* and 205*b*. As shown in FIG. 5A, threaded metal rod A connected to runner guide bar 205 protrudes through base plate 210 and attaches to a threaded fastener B. In one embodiment, threaded fastener B is utilized as friction fittings 206, 207, 208, and 209.

When loosened, friction fittings 206, 207, 208, and 209 allow the base plate 210 and corresponding guide fence unit 202 to pivot freely and be aligned to the angular scale inscribed onto the upper surface 104 of tabletop 103. When tightened, friction fittings 206,207,208, and 209 securely lock and couple the guide fence unit 202 to the runner guide bars 205*a* and 205*b*.

When runner guide bars 205*a* and 205*b* are slideably coupled with guide grooves 105*a* and 105*b*, and friction fittings 206, 207, 208, and 209 are tightened, positioning apparatus 200 may only translate in the direction of the longitudinal axis of tabletop 103. Thus, the user may advantageously control the angular orientation of guide fence unit 202 in relation to the longitudinal axis of translation.

An optional horizontal periscopic optical device 250 may be mounted at the rear of base plate 210 allowing the user to view and align the workpiece from an overhead position. Additionally, as shown only in FIG. 4, the angular alignment of the guide fence unit 202 in relation to the longitudinal axis of translation may also be determined using an alternate graduated angular scale 106*a* inscribed on the right and left rear quadrants of base plate 210.

Referring to FIGS. 2 through 6, an example illustrating the operation of the above-described adjustable router table jig to fabricate a dovetail joint may be briefly described as follows:

Fabricating dovetail sockets comprises the following steps:

a) scribing guide lines on the first workpiece to define the edges of the dovetail sockets;

b) fitting router with a dovetail bit 30 and adjusting the router bit cutter 130 to the proper height;

c) aligning the front edge of the guide fence unit 202 with base line 107 which is perpendicular to the longitudinal orientation of alignment guide grooves 105*a* and 105*b;* d) engaging the friction fittings 206, 207, 208, and 209 locking and coupling guide fence unit 220 to runner guide bars 205*a* and 205*b*;

e) affixing auxiliary strip 260 to the guide fence unit's 202 vertical guide plate's front face 220;

f) sliding the positioning apparatus 200 longitudinally in the alignment run guide grooves 105*a* and 105*b* of tabletop 103 causing the turning router bit 130 to create a guiding profile in the auxiliary strip 260;

g) utilizing the guiding profile, align the first workpiece in accordance with the desired placement of the dovetail socket;

h) clamping the first workpiece to guide fence unit's 202 vertical guide plate's front face 220 utilizing clamp 270;

i) again sliding the positioning apparatus 200 with attached first workpiece longitudinally in the alignment guide grooves 105*a* and 105*b* of tabletop 103 causing the turning router bit 130 to create the dovetail profile in the desired location; and j) repeating steps g–i as necessary to cut all desired dovetail sockets.

Fabricating dovetail pins comprises the following steps:

a) scribing guide lines on the second workpiece to define the edges of the dovetail pins; utilizing dovetail sockets cut in first workpiece, b) fitting the router with a straight bit 40 and adjusting the router bit cutter 130 to the proper height;

c) adjusting the angular orientation of the front edge of the guide fence unit 202 in relation to base line 107 to match the angular dimension 36 of the previously used dovetail bit 30;

d) engaging the friction fittings 206, 207, 208, and 209 locking and coupling guide fence unit 220 to runner guide bars 205*a* and 205*b;* e) affixing auxiliary strip 260 to the guide fence unit's 202 vertical guide plate's front face 220;

f) sliding the positioning apparatus 200 longitudinally in the alignment guide grooves 105*a* and 105*b* of tabletop 103 causing the turning router bit 130 to create a guiding profile in the auxiliary strip 260;

g) utilizing the guiding profile, align the second workpiece in accordance with the desired placement of the dovetail pin;

h) clamping the second workpiece to guide fence unit's 202 vertical guide plate's front face 220 utilizing clamp 270;

i) again sliding the positioning apparatus 200 with attached second workpiece longitudinally in the alignment guide grooves 105*a* and 105*b* of tabletop 103 causing the turning router bit 130 to create the router bit profile in the desired location; and j) repeating steps g–i as necessary to cut one side of all dovetail pins k) loosening friction fittings 206, 207, 208, and 209 allowing guide fence unit 220 to freely pivot in relation to runner guide bars 205*a* and 205*b;* l) reversing the angular orientation of the front edge of the guide fence unit 202 in relation to base line 107 to match the angular dimension 36 of the previously used dovetail bit 30; (e.g., if the first set of cuts are oriented at 15° with the right edge of the guide fence unit forward of the left edge, reverse the orientation of the guide fence unit such that it is oriented at 15° with the left edge of the guide fence unit forward of the right edge.);

m) repeating steps d–j.

It is understood that while the above-described adjustable router table jig is highly adaptable for use in fabricating dovetail joints, those skilled in the art will realize that such an adjustable jig has countless applications to which it is also suited.

It is further understood that while one embodiment of the present invention is fabricated primarily out of baltic birch plywood, the use of injection molding with high strength plastics and well as extruded and milled aluminum are also suitable materials of manufacture. Furthermore, while components are listed as separate individual pieces, it is understood that with modern manufacturing techniques, combining of individual pieces into conglomerate parts may be advantageous to both quality and cost effectiveness.

Thus, it will be understood that various details of the invention may be changed without departing from the scope of the invention. Furthermore, the foregoing description is for the purpose of illustration only, and not for the purpose of limitation—the invention being defined by the claims.

What is claimed is:

1. A device for selectively positioning workpieces to fabricate various types of joints to connect adjoining wooden members using a router, comprising:

a router table, which includes a tabletop having a substantially planar work surface incorporating a horizontally positioned router support platform having a central orifice and means to secure the housing of said router thereto whereby the cutting bit of said router extends upwardly through said central orifice, said tabletop having two parallel alignment guide grooves in said work surface, said alignment guide grooves positioned equidistant from and on opposite sides of longitudinal axis of said cutting bit extending upwardly through said central orifice; and a positioning apparatus comprising a) a guide fence unit having a planar base plate adjacent to said planar work surface and abutting to a perpendicular vertical guide plate, b) two parallel guide bar means which are adapted to fit within and translate along the longitudinal axis of said alignment guide grooves, c) coupling means for conjoining said guide bar means to said guide fence unit wherein said coupling means allows said guide fence unit to be pivotally aligned in relation to the longitudinal axis of said guide bar means, and d) locking means for securing said alignment between said guide fence unit and said guide bar means.

2. The device according to claim 1, wherein said vertical guide plate of said guide fence unit has a central sighting aperture for viewing and aligning said workpiece from the rear.

3. A device as in any of the preceding claims, further including a graduated angular scale with its base line oriented perpendicular to the longitudinal axis defined by said guide grooves.

4. A device as in claim 3, wherein said graduate angular scale is inscribed onto said work surface of said tabletop.

5. A device as in claim 3, wherein said graduate angular scale is inscribed onto the rear of said base plate of said guide fence unit.

6. A device as in any of the preceding claims, further including a translucent, protective cover shield centrally located over said aperture to protect the user from debris ejected through said aperture.

7. A device as in any of the preceding claims, wherein a periscopic optical device is horizontally mounted at the rear of said base plate which allows the user to view and align said workpiece from an overhead position.

8. A method of fabricating dovetail joinery utilizing a router affixed to a router table having two parallel alignment guide grooves and a positioning apparatus comprised of a guide fence unit and two pivotally coupled guide runners, comprising:

forming dovetail sockets in a first workpiece comprising the following steps a) scribing guide lines on said first workpiece to define the edges of said dovetail sockets, b) fitting said router with a dovetail bit cutter and adjusting said dovetail bit cutter to the proper height, c) aligning front edge of said guide fence unit with a base line which is perpendicular to the longitudinal orientation of said alignment guide grooves, d) engaging a locking means to lock said guide fence unit to said guide runners, e) affixing a first auxiliary strip to front face of a vertical guide plate on said guide fence unit, f) sliding said positioning apparatus longitudinally in said alignment guide grooves causing said turning router bit to create a first guiding profile in said first auxiliary strip, g) utilizing said first guiding profile, align said first workpiece in accordance with the desired placement of said dovetail socket, h) clamping said first workpiece in front of said first auxiliary strip attached to said guide fence unit's vertical guide plate's front face utilizing clamping means, i) sliding said positioning apparatus with attached said first workpiece longitudinally in said alignment guide grooves causing said turning router bit to create the dovetail profile in the desired location; and j) repeating steps g–i as necessary to cut all desired dovetail sockets; and forming dovetail pins in a second workpiece comprising the following steps k) scribing guide lines on said second workpiece to define the edges of the dovetail pins; utilizing said dovetail sockets cut in said first workpiece, l) fitting said router with a straight bit cutter and adjusting said straight router bit cutter to the proper height, m) loosening said locking means allowing said guide fence unit to freely pivot in relation to said guide runners, n) adjusting said angular orientation of said front edge of said guide fence unit in relation to said base line to match the angular dimension of the previously used said dovetail bit cutter, o) engaging said locking means coupling said guide fence unit to said guide runners, p) affixing a second auxiliary strip to said guide fence unit's vertical guide plate's front face, q) sliding said positioning apparatus longitudinally in said alignment guide grooves causing said turning router bit to create a second guiding profile in said second auxiliary strip, r) utilizing said second guiding profile, align said second workpiece in accordance with the desired placement of the dovetail pin, s) clamping said second workpiece in front of said second auxiliary strip attached to said guide fence unit's vertical guide plate's front face utilizing said clamping means, t) sliding said positioning apparatus with attached said second workpiece longitudinally in said alignment guide grooves causing said turning router bit to create a router bit profile in the desired location, u) repeating steps r–t as necessary to cut one side of all dovetail pins, v) loosening said locking means allowing said guide fence unit to freely pivot in relation to said runner guide bars, w) reversing said angular orientation of said front edge of said guide fence unit in relation to said base line to match the said angular dimension of said previously used dovetail bit, and x) repeating steps o–u, utilizing a third auxiliary strip and third guiding profile, respectively, in the place of said second auxiliary strip and said second guiding profile.

* * * * *